United States Patent [19]

Valenti

[11] Patent Number: 5,057,819

[45] Date of Patent: Oct. 15, 1991

[54] ALARMED SAFETY CUSHION

[76] Inventor: James J. Valenti, 806 Sussex Rd., Franklin Lakes, N.J. 07417

[21] Appl. No.: 516,065

[22] Filed: Apr. 27, 1990

[51] Int. Cl.[5] ..... G08B 23/00

[52] U.S. Cl. ..... 340/573; 340/539; 340/665; 340/666

[58] Field of Search ..... 340/573, 539, 665-667, 340/568, 323 R; 5/417

[56] References Cited

U.S. PATENT DOCUMENTS

| | | | |
|---|---|---|---|
| Re. 24,618 | 3/1959 | Rosenberg et al. . | |
| 184,487 | 11/1976 | White . | |
| 1,922,979 | 8/1933 | Rechtschaffen | 5/348 |
| 2,260,715 | 10/1941 | Ketchem | 340/573 X |
| 2,734,104 | 2/1956 | Gollhofer | 340/686 X |
| 2,780,693 | 2/1957 | McClellan | 340/666 X |
| 2,783,327 | 2/1959 | Luckey | 340/666 X |
| 3,027,967 | 4/1962 | Silver | 182/137 |
| 4,066,072 | 1/1978 | Cummins | 128/40 |
| 4,094,021 | 6/1978 | Rapp | 4/172.12 |
| 4,242,672 | 12/1980 | Gault | 340/667 X |
| 4,727,697 | 3/1988 | Vaux | 52/177 |
| 4,780,706 | 10/1988 | Bollag | 340/666 |
| 4,951,032 | 8/1990 | Langsam | 340/573 X |

*Primary Examiner*—Glen R. Swann, III
*Assistant Examiner*—Thomas J. Mullen, Jr.

[57] ABSTRACT

A safety cushion provides a mattress for cushioning the fall of a child, and an alarm for alerting an adult of such a fall; and specifically includes an air mattress and an alarm in circuit connection with a pressure-responsive switch disposed within the air mattress.

8 Claims, 4 Drawing Sheets

ALARMED SAFETY CUSHION

BACKGROUND OF THE INVENTION

1. Field of the Invention

This invention pertains in general to a safety cushion, and in particular to an alarmed safety air-mattress for the protection of unsupervised children in child-fall situations, and for the notification of an adult of the child-fall.

2. Related Prior Art

This invention addresses the long-felt need of ensuring the safety of unsupervised children. The safety cushion is designed to be employed for the protection of a child when a child is left unsupervised by an adult in an elevated location (such as on a crib, a bed, a chair, etc.), ensuring the safety of the child by cushioning any fall and alerting an adult of such a fall.

This invention provides a means for protecting a child when the child is left unsupervised by an adult in an elevated location. This invention ensures the safety of a child by cushioning any fall of a child from an elevated location and simultaneously alerting an adult of the fall. Previous work in this field has not been satisfactory to accomplish these ends. Pressure switches have been provided which are used to define areas of travel or limit the movement of children but not to protect children from injury that may result from a fall. Additionally, electronic devices have been combined with mattresses to indicate the movement or activity of patients in hospital surroundings or surroundings of other type of confinement. These prior works do not anticipate the safety features of the alarmed safety cushion.

Several patents have dealt with this general area, as follows: U.S. Pat. Nos. Re. 24,618; 184,487; 1,922,979; 2,260,715; 2,780,693; 2,783,327; 3,027,967; 4,094,021; 4,242,672; and 4,780,706. These patents are incorporated by reference in this application. None of these patents, however, are thought either singly or in combination address the problems of the present invention or to provide the solutions.

U.S. Pat No. Re. 24,618 discloses an inflatable plastic cushion having straps. It is used as a boat seat and as a floatation device.

U.S. Pat. No. 184,487 discloses air and water beds having a series of compartments or sacks which can be independently filled or drained.

U.S. Pat. No. 1,922,979 discloses an air mattress or cushion, having material interposed between lattice-like openings in an unitary air container, which is contained in a jacket for limiting expansion.

U.S. Pat. No. 2,260,715 discloses a circuit closer in a normally closed position which is placed under a mattress. It is opened with the weight of a person on a mattress. The circuit is connected to a light so that the weight of a person on the mattress opens the circuit and the light is off, but when one lifts oneself from the mattress, the circuit closes and the light is illumined.

U.S. Pat. No. 2,780,693 discloses a pressure switch device that is incorporated in the body of a resilient compressive material consisting of two conducting layers normally out of contact but engaged upon the application of pressure so that a circuit is closed.

U.S. Pat. No. 2,783,327 discloses a molded, metal-backed electrical mat switch and a method of making the same.

U.S. Pat. No. 3,027,967 discloses a strong, fire resistent net to be used for catching people in fire emergency situations.

U.S. Pat. No. 4,094,021 discloses a plastic swimming pool cover which fits within a swimming pool, below the deck, and has a skirt extending downward. It also has a fastening means consisting of a Velcro strap riveted to the cover.

U.S. Pat. No. 4,242,672 discloses a patient monitoring system consisting of a switch placed in a bed which is closed while the bed is occupied but opens when the weight on the bed is removed so as to activate an alarm. Also disclosed is a circuit which when opened gives an immediate audible alarm and a visible alarm shortly thereafter. The visible alarm continues until reset while the audible alarm may be terminated earlier by returning the patient to his or her proper position.

U.S. Pat. No. 4,780,706 discloses an infant training device and method. It consists of a mat responsive to the pressure of an animal or child, and an alarm which is activated either by pressure or alternatively the absence thereof.

SUMMARY OF THE INVENTION

The present invention provides an air holding cushioning means having fastening means which allows it to be attached to furniture on which a child is placed. The cushioning means includes a pressure actuated signaling means which senses the high pressure resulting from the fall of a child from an elevated position and triggers a signaling means which can be either audible or visual and can be either at the location of the cushioning means or at a point remote from the cushioning means.

It is an object of the invention to provide for means for cushioning the fall of a child.

It is another object of the invention to provide means for cushioning which can be secured in the proper position in relation to furniture on which a child is disposed to ensure that if the child were to fall from the furniture that he/she will land on the cushioning means.

It is a further object of the invention to provide means for securing the cushioning means in the proper location so that it cannot be accidentally displaced or moved by pets or people moving about in a darkened area where babies are often left to sleep.

Another object of the present invention is to provide a means to alert an adult, responsible for a child, of the child's fall from a location where the child has been left. This can be accomplished by a signaling means coupled with a pressure responsive means and associated with the cushioning means. The signaling means may be an alarm and may be internally or externally mounted with respect to the cushioning means. Further, the alarm can be an electronic communication device having a transmitter at the mattress and a portable receiver carried by the adult, thus allowing the adult greater freedom of mobility.

Still a further object of this invention is that it can be easily inflated and deflated to allow for easy storage and convenient transportation.

These, as well as further objects and advantages of this invention, will become apparent to those skilled in the art from a review of the accompanying detailed description of the preferred embodiment, reference being made to the accompanying drawings.

DESCRIPTION OF THE PREFERRED EMBODIMENT

The safety cushion of the present invention is designed to cushion the fall of a child, render the fall harmless, and alert an adult of the fall.

Figure 1:
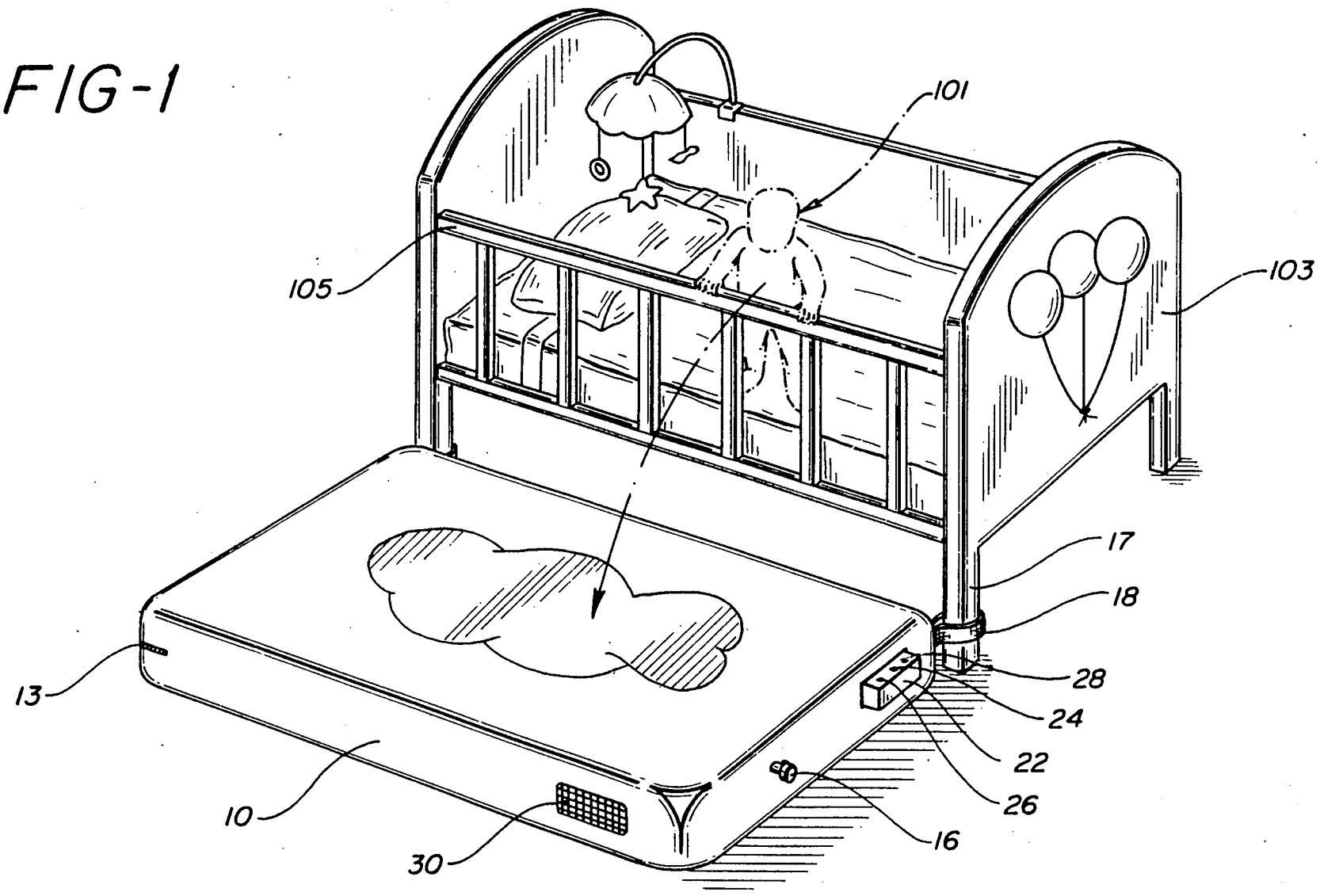
FIG. 1 is a perspective view of the safety cushion in its normal operation (attached to a child's crib).

The safety cushion invention is shown in FIG. 1 in its intended position for its intended use. The safety cushion 10 is attached to a crib 103 and cushions the fall of a child 101 who climbs over the railing guard 105 of the crib.

Figure 2:
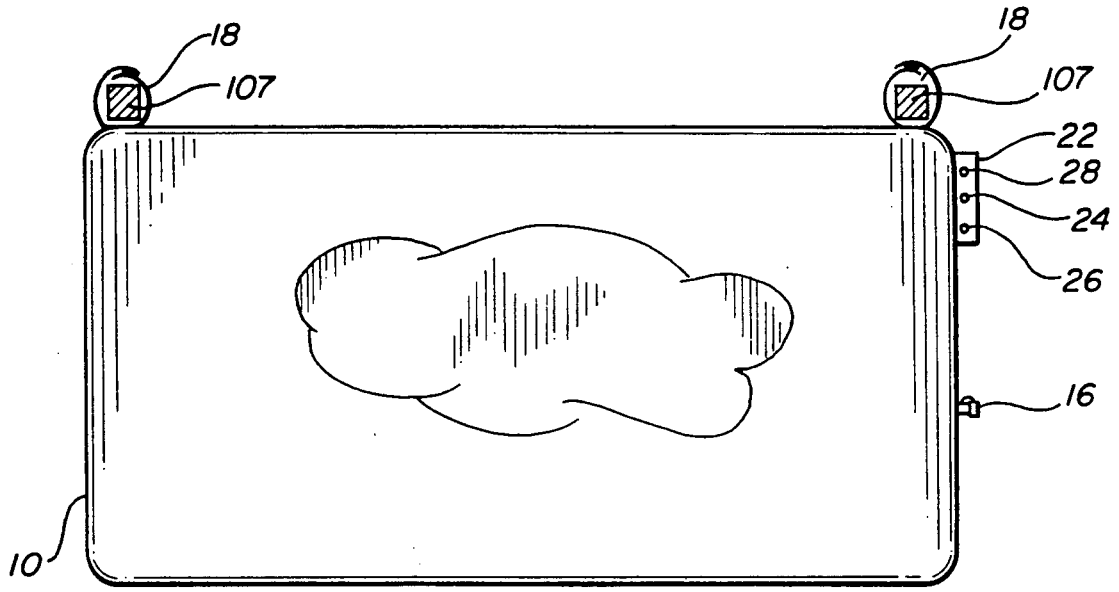
FIG. 2 is a top plan view of the safety cushion.
Figure 3:
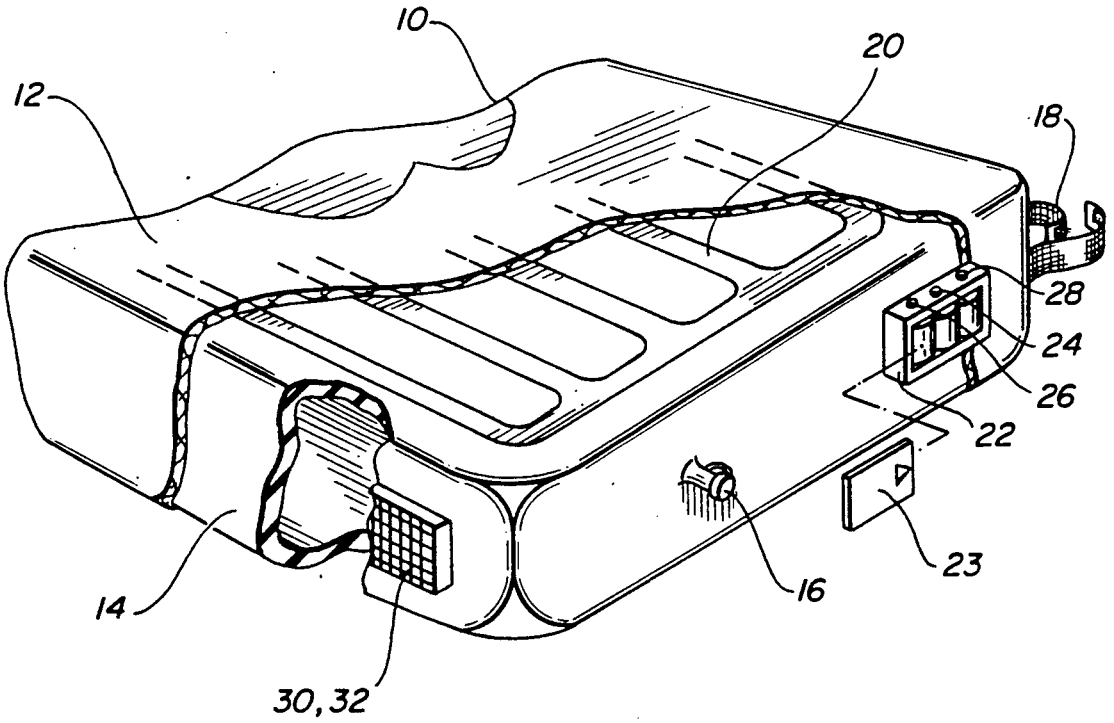
FIG. 3 is a perspective view of the safety cushion with the outer casing broken away to expose the pressure-responsive switch element.

The invention as shown in FIG. 3 comprises a safety cushion 10, typically an air mattress, having an outer casing 12, and an inner air bladder 14. The outer casing is typically plastic which is sufficiently strong to withstand the force of a falling child 101. The outer casing is secured around the inner air bladder by a zipper means 13 which allows the outer casing to be easily removed in the event that a repair needs to be made in connection with the inner air bladder or the circuitry disposed within the outer casing. Further, the outer casing is constructed such that an air valve 16, attached to the inner air bladder, and a battery compartment, 22 attached to circuitry internal to the outer casing, are allowed to extend through the outer casing, so as to be conveniently positioned external to the air mattress. Also attached to the outer casing, as shown in FIG. 2, are straps 18, having hook and pile fastening means, which allow the mattress to be securely positioned against the legs of a crib or other piece of furniture on which a child is located.

The inner bladder 14 as shown in FIG. 3, is typically made of rubber and is designed to retain air. An air valve 16 for inflation and deflation of the mattress is integral to the bladder and extends through the outer casing. The air valve is of a construction which allows one to orally inflate the mattress and allows for deflation only upon the application of pressure to a defined portion of the valve. The air bladder is of sufficient thickness and strength to cushion the fall of the average child.

A high pressure signaling means, which acts in cooperation with the mattress, is provided to alert an adult of a child-fall. The signaling means is typically an alarm 30. The alarm is typically activated by a pressure-responsive element disposed within the mattress. As shown in FIG. 3, the pressure-responsive element is preferably a tape switch 20 which is disposed between the outer casing of the mattress and the inner air bladder and is secured to the inner air bladder so as to prevent any shifting movement when the mattress is deflated. Tape switches are well known to those familiar with the art. The weight of a child on the mattress provides sufficient pressure to compress the conductive elements of the tape switch into electrical communication so as to close the circuit and sound the alarm.

Figure 4:
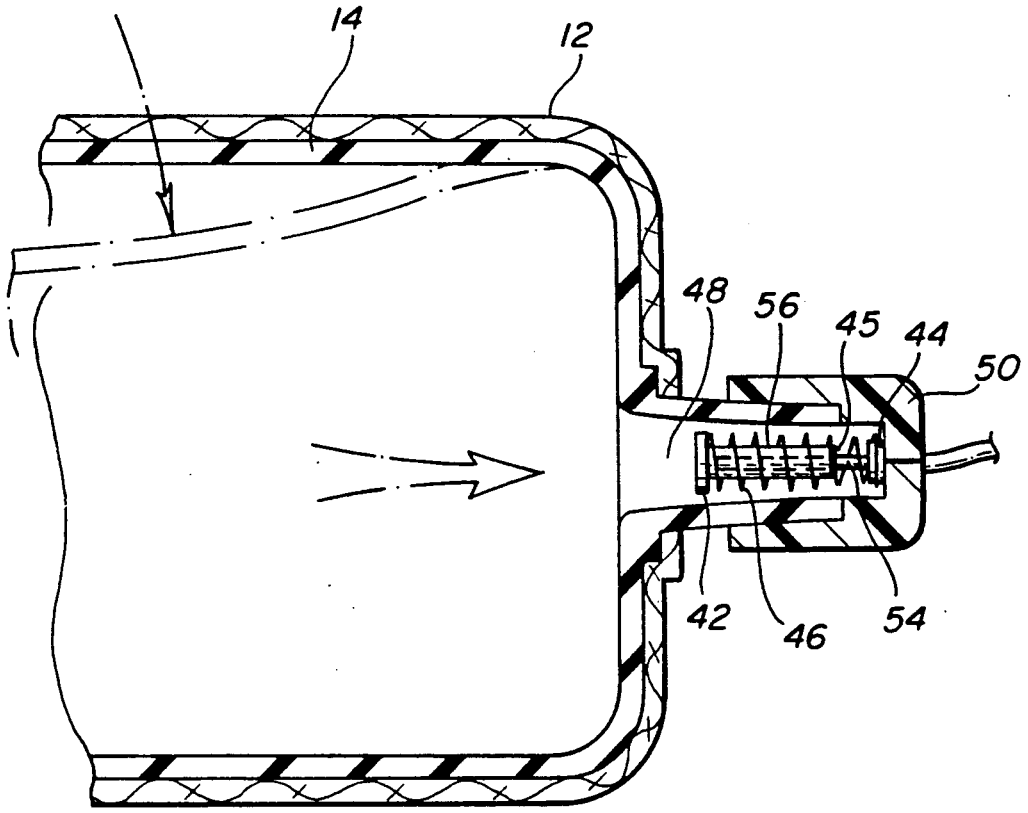
FIG. 4 is a cross-sectional view of an alternative pressure-responsive switch embodiment.

FIG. 4 shows an alternative pressure-responsive switch configuration. In this embodiment an air space 48 extends from the inner air bladder 14 through the outer casing 12. Disposed within the air space 48 is a shaft 54 which is anchored at the far end of the air space, its base being an electrical contact 44. Enveloping the shaft 54 is a sleeve 56 which rides on the shaft 54 and is axially moveable with respect to the electrical contact 44. The sleeve has an electrical contact 45 at one end and a plunger 42 at its other end. Electrical contacts 44 and 45 are normally biased out of contact by a spring 46. However, as a result of a child's fall, air impacts on the plunger with a force sufficient to move the sleeve along the shaft, to compress the spring, and force electrical contacts 44 and 45 into electrical communication, thereby completing the electrical circuit and activating the alarm. Further, this embodiment could be conveniently located within the air valve 16.

Figure 6:
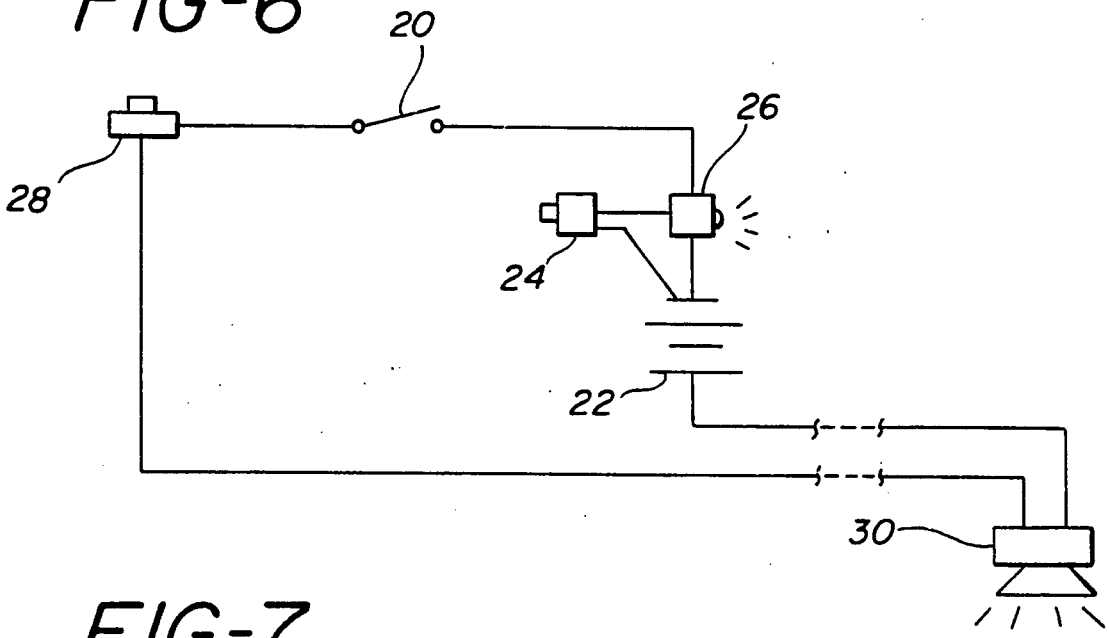
FIG. 6 is a schematic of the alarm circuit having a remotely positioned alarm.

The signaling means is typically an alarm 30 and typically provides an audio signal. In the preferred embodiment, FIG. 6, the alarm is positioned remotely with respect to the mattress so that a child, which has been the victim of a fall, is not further shocked by the sounding of an alarm in close proximity.

Figure 5:
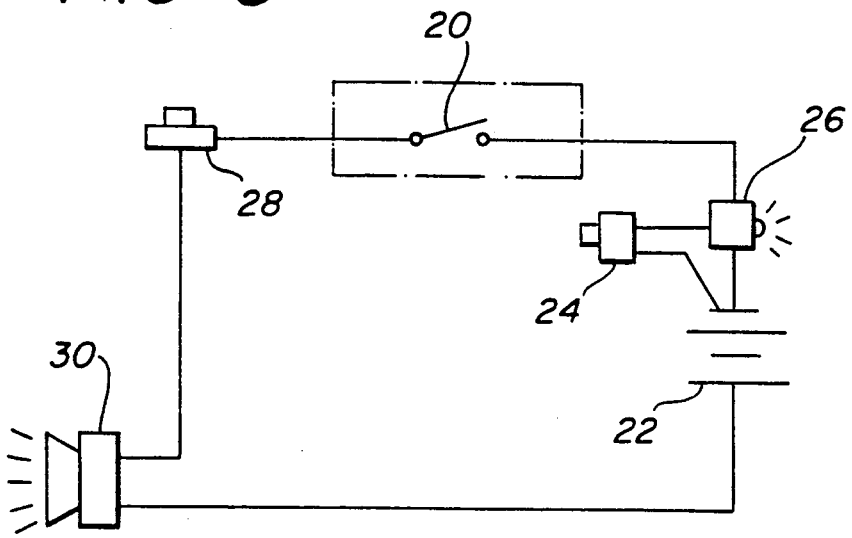
FIG. 5 is a schematic of the basic alarm circuit used in connection with the safety cushion.

To facilitate portability, in an alternative embodiment the alarm is disposed within the mattress, FIG. 1 and FIG. 5. In this alternative embodiment, the alarm is positioned at one sidewall of the mattress and sound is directed horizontally away from the mattress.

Figure 7:
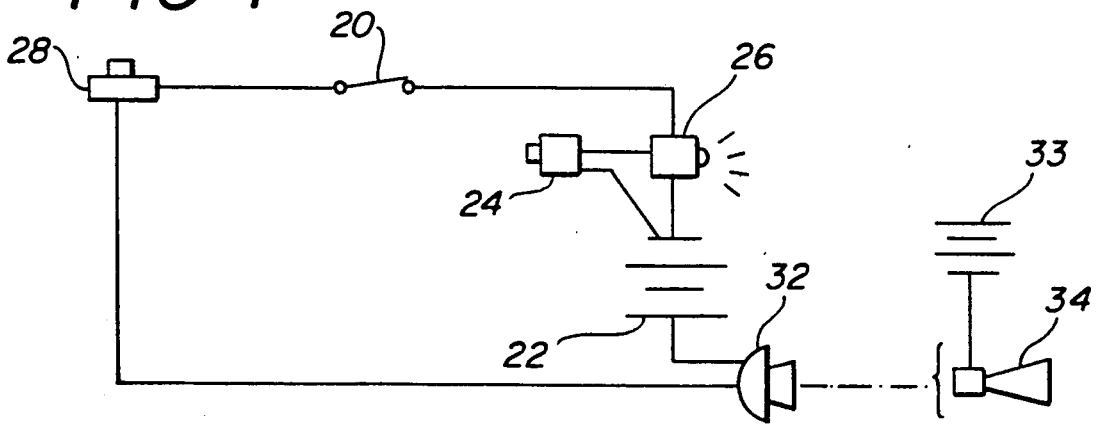
FIG. 7 is a schematic of an alarm circuit having an electronic communications device.

In still another embodiment, FIG. 7, the alarm is an electronic communications device having a transmitter 32 mounted on the mattress or on the battery compartment 22, and a receiver 34 which receives a signal from the transmitter and converts it into an audible alarm. The receiver has its own power source 33 and can be transported by the supervising adult so that the adult may have an even greater flexibility of movement and still be alerted to the fall of a child.

The electrical circuitry of the invention is powered, in the preferred embodiment, by a DC power source 21. The battery compartment 22 is typically mounted adjacent to one edge of the safety cushion to prevent its interference with the cushioning of the fall of a child, but it may also be positioned remotely. The battery compartment may be permanently attached to the safety cushion, or may be removable to facilitate transportation. Further, an AC power source, along with an AC converter, may be used.

A reset switch 28 is provided so that the alarm can be silenced after a fall and readied for a subsequent fall. Also provided is a battery indicator 26 for use with a direct current power source.

A low pressure indicating means is provided for indicating when air pressure in the safety cushion is insufficient to successfully and safely cushion the fall of a child. The low pressure indicating means comprises a pressure responsive switch 24 connected in series with the battery indicator on the battery compartment. When sufficient air pressure is present, the pressure responsive switch closes the circuit and lights up the indicator on the battery compartment, indicating that the safety cushion may be safely used. When insufficient pressure is present, the circuit remains open and the indicator light is extinguished, indicating that the safety cushion is not properly inflated and should not be used. Thus, the low pressure indicating means functions as a power saver because a sufficient amount of pressure must be present in the cushioning means prior to completion of the circuitry.

The safety cushion is attachable to the crib by 107 or furniture in or on which a child is located, typically by straps 18, having a hook and pile fastening means, attached to the outer casing. The straps allow an adult who is supervising a small child the freedom to periodically leave the child without fear of the mattress being pushed away from its intended position by household pets, other children, etc.

Having thus described my invention in detail, it is understood that the foregoing description is not intended to limit the spirit and scope thereof. What is desired to be protected by Letters Patent is set forth in the appended claims.

I claim:

1. A safety device for signaling the location of a child and preventing injury to the child comprising:

air holding cushioning means comprising:

bladder means for holding a quantity of air under pressure;

inflation means for placing air under pressure into the bladder means and retaining the air in the bladder means;

pressure actuated signaling means comprising:

pressure sensing means disposed on the upper surface of the cushioning means;

low pressure setting means for indicating when insufficient air pressure is located in the air holding cushioning means, the low pressure indicating means including means for disconnecting the electrical circuit from a power means;

high pressure actuated means for indicating the presence of high pressure on the cushioning means;

electric circuit means operatively associated with the pressure activated signaling means;

transmitting means for transmitting a signal to a remote location;

receiver means for receiving signal remotely from the location of the cushioning means; and means for attaching said cushioning means to furniture legs comprising:

straps extending from the sides of the cushioning means;

said straps having hook and pile fabric to enable the fastening of the straps to themselves.

2. The safety device of claim 1 wherein the electric circuit means comprises a direct current power source.

3. The safety device of claim 2 wherein the electric circuit means comprises an alternating current power source.

4. A safety device for signaling the location of a child and preventing injury to the child comprising:

air holding cushioning means, adapted to cushion the fall of a child from the height of a crib or a bed to prevent injury to the child falling on the cushioning means;

signaling means for indicating the presence of high pressure on the cushioning; and means for attaching the cushioning means to the legs of a crib or bed to secure the cushioning means in the proper location to cushion the fall of a child should the child fall from the furniture.

5. The safety device of claim 4 wherein said pressure actuated signaling means comprises a pressure responsive switch located within the air holding cushioning means, the pressure responsive switch closing on the application of the force of a child falling on the cushioning means.

6. The safety device of claim 5 wherein the pressure actuated signaling means further comprises an alarm disposed within the air holding cushioning means.

7. The alarmed safety cushion of claim 5 wherein the pressure actuated signaling means further comprises an alarm remotely positioned with respect to said air holding cushioning means.

8. The safety device of claim 5 wherein said pressure actuated signaling means further comprises an electronic communications device comprising a transmitter and a receiver.

* * * * *